US009746187B2

(12) United States Patent
Kim et al.

(10) Patent No.: US 9,746,187 B2
(45) Date of Patent: Aug. 29, 2017

(54) MULTI-GLASS DOOR COOLING OVEN

(75) Inventors: Kyoung Ho Kim, Yongin-si (KR); Yun Ic Hwang, Suwon-si (KR); Seok Weon Hong, Yongin-si (KR); Jong Hak Hyun, Seoul (KR); Cheol Jin Kim, Suwon-si (KR); Yu Jeub Ha, Suwon-si (KR); Min Serk Kim, Seoul (KR); Kil Young Lee, Hwaseong-si (KR); Eun Oh Kim, Seoul (KR); Jin Hee Cho, Seoul (KR); Chan Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1629 days.

(21) Appl. No.: 12/216,999

(22) Filed: Jul. 14, 2008

(65) Prior Publication Data

US 2009/0194090 A1 Aug. 6, 2009

(30) Foreign Application Priority Data

Feb. 5, 2008 (KR) ..... 10-2008-0011962

(51) Int. Cl.

| | |
|---|---|
| ***F24C 15/04*** | (2006.01) |
| ***F24C 15/08*** | (2006.01) |
| ***F24C 15/32*** | (2006.01) |
| ***F24C 15/00*** | (2006.01) |
| *F28D 15/00* | (2006.01) |

(52) U.S. Cl.

CPC ..... *F24C 15/006* (2013.01); *F24C 15/04* (2013.01)

(58) Field of Classification Search

USPC ..... 126/198, 19 R, 21 A, 200, 193; 165/104.34, 104.33, 265

See application file for complete search history.

(56) References Cited

U.S. PATENT DOCUMENTS 3,692,015 A * 9/1972 Chase et al. ..... 126/200
3,889,100 A * 6/1975 Dills ..... 219/393

(Continued)

FOREIGN PATENT DOCUMENTS

KR 10-0600743 7/2006
KR 10-0678666 1/2007

(Continued)

OTHER PUBLICATIONS

Korean Office Action issued Sep. 18, 2012 in corresponding Korean Patent Application No. 10-2008-0011962.

*Primary Examiner* — Steven B McAllister
*Assistant Examiner* — Desmond C Peyton
(74) *Attorney, Agent, or Firm* — Staas & Halsey LLP

(57) ABSTRACT

An oven, which both satisfies heat insulating and cooling of a door by adjusting an air flow in channels formed in the door. The oven includes a plurality of channels provided in a door, into which external air flows, accompanied with air discharged by a discharge duct, such that the air flows in the plurality of the channels, and a flow conversion part formed above at least one of the plurality of the channels for stagnating the flow of air. Since the door insulates a cooking chamber from heat and is cooled using a difference of pressures between upper and lower portions of the door, the oven concurrently satisfies conflicting two requirements, such as heat insulating and cooling of the door.

8 Claims, 8 Drawing Sheets

(56) References Cited

U.S. PATENT DOCUMENTS

| | | | | |
|---|---|---|---|---|
| 3,996,710 | A * | 12/1976 | Nuss | F24C 15/04 126/200 |
| 4,207,863 | A * | 6/1980 | Drouin | 126/198 |
| 5,107,821 | A * | 4/1992 | von Blanquet | 126/19 R |
| 5,387,258 | A * | 2/1995 | Puricelli | 126/21 A |
| 5,918,589 | A * | 7/1999 | Valle et al. | 126/193 |
| 6,904,904 | B2 * | 6/2005 | Walther et al. | 126/198 |
| 7,368,683 | B2 * | 5/2008 | Kim et al. | 219/400 |
| 7,368,684 | B2 * | 5/2008 | Kim et al. | 219/400 |
| 7,547,862 | B2 * | 6/2009 | Kim et al. | 219/400 |
| 7,708,007 | B2 * | 5/2010 | Kim | F24C 15/04 110/175 R |
| 7,847,219 | B2 * | 12/2010 | Kim et al. | 219/391 |
| 7,856,973 | B2 * | 12/2010 | Kim et al. | 126/273 R |
| 2005/0133019 | A1 * | 6/2005 | Kim | F24C 15/04 126/198 |
| 2006/0219234 | A1 * | 10/2006 | Larsen | 126/198 |
| 2006/0225727 | A1 * | 10/2006 | Kim et al. | 126/21 A |
| 2006/0237425 | A1 * | 10/2006 | Kim et al. | 219/400 |
| 2007/0158330 | A1 * | 7/2007 | Kim et al. | 219/400 |

FOREIGN PATENT DOCUMENTS

| | | |
|---|---|---|
| KR | 10-0678666 | 2/2007 |
| KR | 10-0743713 | 7/2007 |

* cited by examiner

MULTI-GLASS DOOR COOLING OVEN

CROSS-REFERENCE TO RELATED APPLICATIONS

This application claims the benefit of Korean Patent Application No. 2008-0011962, filed Feb. 5, 2008, in the Korean Intellectual Property Office, the disclosure of which is incorporated herein by reference.

BACKGROUND

1. Field

Embodiments of the present invention relate to an oven, and more particularly, to an oven, which concurrently satisfies heat insulating and cooling of a door.

2. Description of the Related Art

In general, ovens are cooking apparatuses, which are designed to cook food materials with dry heat in a hermetically sealed cooking chamber. Ovens are divided into electric ovens and gas ovens according to the kinds of heat sources used. These heat sources serve to transmit heat of a high temperature to the inside of a hermetically sealed space in an oven. Further, a door is installed on the front surface of an oven and hermetically seals a cooking chamber so as to prevent heat of a high temperature from being discharged to the outside of the oven, thus allowing food to be cooked at a high temperature.

However, in the case that the high-temperature heat in the cooking chamber is transmitted directly to the door, a user may get burnt on the hand. Korean Patent Registration No. 10-0678666 discloses a door cooling system for an oven range. That is, the door cooling system, disclosed in Korean Patent Registration No. 10-0678666, cools a door of the oven range by forced convection and natural convection through an air flow channel formed in the door.

On the other hand, the door must have a heat insulating performance such that the door can hermetically seal the inside of a cooking chamber so as to prevent heat of a high temperature from being charged to the outside of the cooking chamber. When the heat insulating performance of the door is excellent, cooking time within the cooking chamber is greatly reduced. The reduction of cooking times features several advantages, such as a decrease in the power consumption of an oven.

Consequently, in the case that only the cooling of the door is emphasized so as to prevent the door from getting hot due to heat transmitted from the cooking chamber, the heat insulating effect of the door is lowered, and in the case that only the heat insulating of the door is emphasized so as to prevent the heat transmitted from the cooking chamber from being discharged to the outside, the cooling effect of the door is lowered. Thus, the development of a door of an oven, which can satisfy conflicting two requirements, such as heat insulating and cooling of the door, has been required.

SUMMARY

Therefore, one aspect of embodiments of the present invention is to provide an oven, which adjusts the flow of air in a channel formed in the oven door so as to concurrently satisfy heat insulating and cooling.

Additional aspects and/or advantages will be set forth in part in the description which follows and, in part, will be apparent from the description, or may be learned by practice of the invention.

In accordance with one aspect, embodiments of the present invention provide an oven comprising an internal case having a cooking chamber, a door for opening and closing the front surface of the cooking chamber, a cooling fan installed above the cooking chamber for inhaling external air and blowing the air, a discharge duct for discharging the air, blown by the cooling fan, in the forward direction of the door, a plurality of channels provided in the door, into which external air flows, accompanied with the air discharged by the discharge duct, such that the air flows in the plurality of the channels, and a flow conversion part for stagnating the flow of air in at least one of the plurality of the channels.

The air, discharged by the discharge duct, may be discharged to the top of the door, and the external air may enter the lower portions of the plurality of the channels, accompanied with the air discharged to the top of the door, and flow upwardly.

The flow conversion part may be protruded from the front surface of the internal case.

The door may include a plurality of glasses for forming the plurality of the channels; and the flow conversion part may be connected to at least one of the plurality of the glasses.

In accordance with another aspect, embodiments of the present invention provide an oven comprising a door frame, a front glass and a rear glass, respectively installed on the front and rear surfaces of the door frame, at least two middle glasses installed between the front glass and the rear glass, a front channel formed between the front glass and the middle glass being adjacent thereto such that air can flow in the front channel, a rear channel formed between the rear glass and the middle glass being adjacent thereto such that air can flow in the rear channel, and at least one middle channel formed between the at least two middle glasses such that the flow of air can be stagnated in the at least one middle channel by the flow of the air passed through the rear channel.

Two middle glasses may be installed between the front glass and the rear glass; and a middle channel, in which the flow of air is stagnated, may be formed between the two middle glasses.

The oven may further comprise a cooling fan for inhaling external air and blowing the air, and a discharge duct for discharging the air, blown by the cooling fan, to the top of the door frame, wherein air flows upwardly in the front channel and the rear channel.

The oven may further comprise a flow conversion part formed above the rear channel for converting the direction of the air, passed through the rear channel, so as to allow the air to enter the at least one middle channel.

The oven may further comprise an internal case having a cooking chamber opened and closed by the door frame, wherein when the door frame closes the cooking chamber, the flow conversion part is protruded from the front surface of the internal case.

The flow conversion part may be formed integrally with the internal case.

The flow conversion part may be connected to the rear glass, and is bent toward the at least two middle glasses.

At least three middle glasses may be installed between the front glass and the rear glass, and at least two middle channels may be formed between the at least three middle glasses, and the oven may further comprise a flow conversion part formed above any one of the at least two middle channels for converting the direction of the air so as to allow the air to enter another one of the at least two middle channels.

In accordance with yet another aspect, embodiments of the present invention provide an oven comprising a door frame, a front glass and a rear glass, respectively installed on the front and rear surfaces of the door frame; at least one middle glass installed between the front glass and the rear glass, a rear channel formed between the at least one middle glass and the rear glass such that air can flow in the rear channel, and a front channel formed between the front glass and the at least one middle glass such that the flow of air can be stagnated in the front channel by the inflow of the air passed through the rear channel.

The oven may further comprise a flow conversion part formed above the rear channel for converting the direction of the air, passed through the rear channel, so as to allow the air to enter the front channel.

The oven may further comprise an internal case having a cooking chamber opened and closed by the door frame, wherein when the door frame closes the cooking chamber, the flow conversion part is protruded from the front surface of the internal case.

The flow conversion part may be connected to the rear glass, and is bent toward the at least one middle glass.

At least two middle glasses may be installed between the front glass and the rear glass, and the oven further comprise a flow conversion part formed above at least one middle channel for converting the direction of the air, passed through the at least one middle channel, so as to allow the air to enter the front channel.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF EMBODIMENTS

Figure 1:
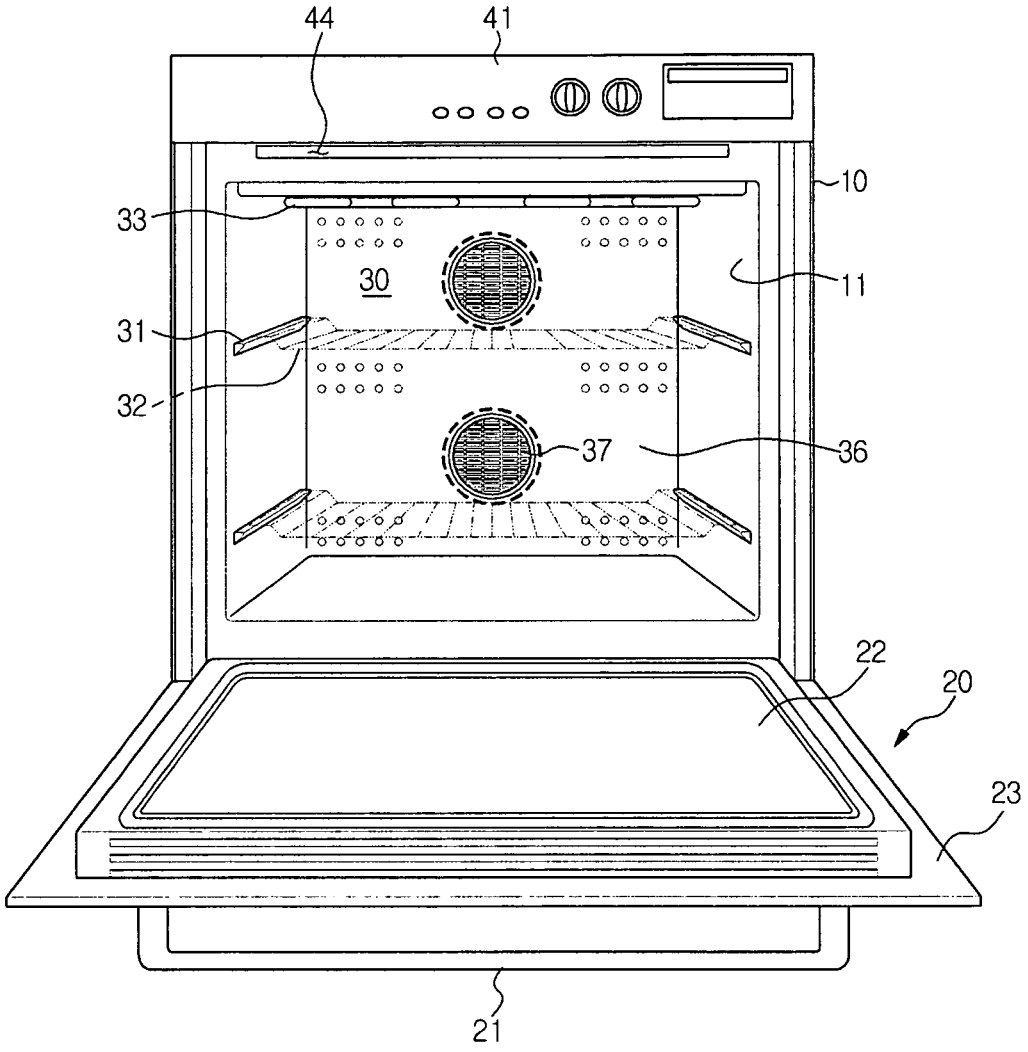
FIG. 1 is a perspective view of an oven in accordance with an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Figure 2:
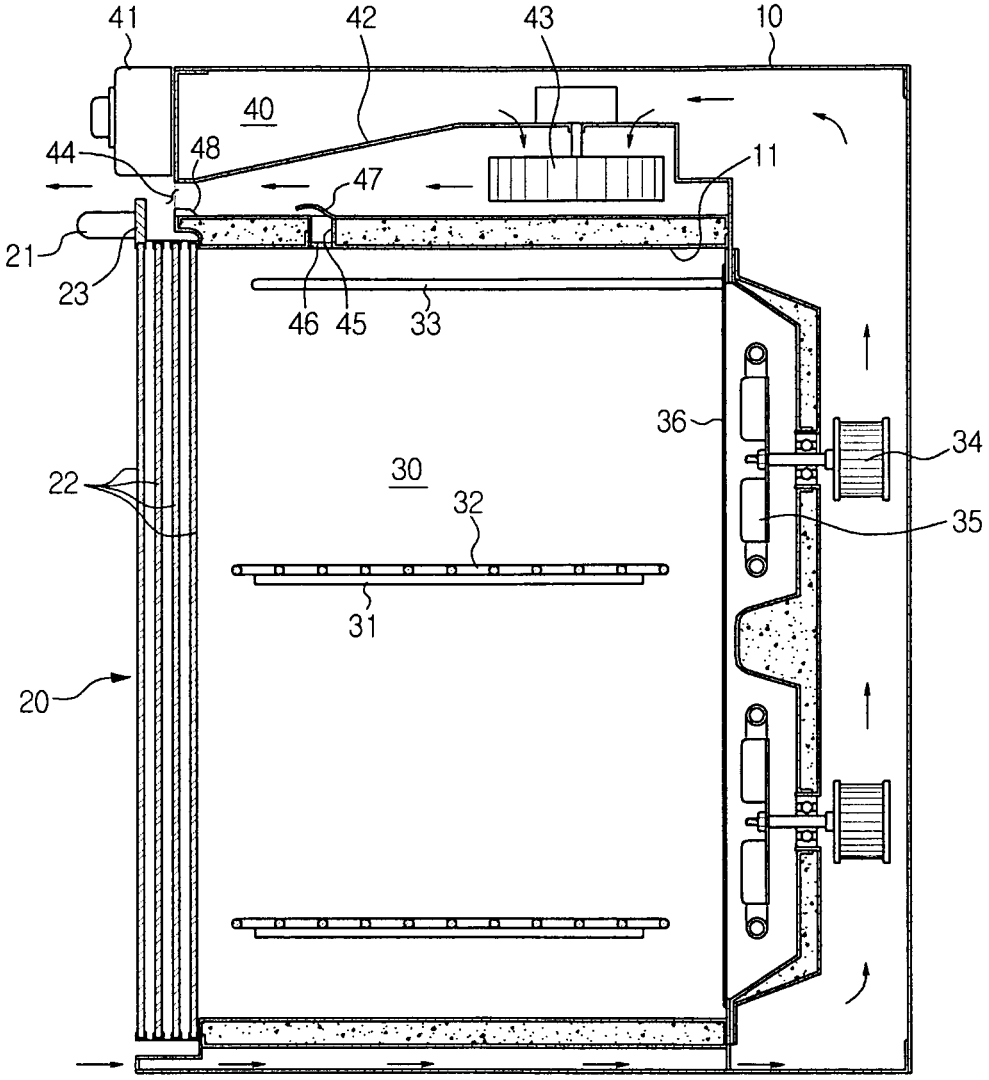
FIG. 2 is a cross-sectional view of an oven in accordance with an embodiment of the present invention.

FIG. 1 is a perspective view of an oven in accordance with an embodiment of the present invention, and FIG. 2 is a cross-sectional view of the oven in accordance with an embodiment of the present invention, for example as shown in FIG. 1.

As shown in FIGS. 1 and 2, the oven in accordance with an embodiment of the present invention includes an external case 10 having a hexahedral shape, the front surface of which is opened, an internal case 11 installed in the external case 10 and having a hexahedral shape, the front surface of which is opened, in the same surface as the external case 10, a door 20 hinged to the lower end of the internal case 11 so as to open and close the opened front surface of the internal case 11, and a handle 21 provided on the front surface of the door 20 and gripped by a user so as to simply open and close the door 20.

A cooking chamber 30, in which food is cooked, is provided in the internal case 11. A plurality of guide rails 31 may be installed at the medium region of the inside of the cooking chamber 30, and thus allows racks 32 to be simply attached to and detached from the guide rails 31 in the cooking chamber 30. A heater 33 for heating food materials put on the racks 32 may be installed on the upper portion of the cooking chamber 30. Fan motors 34 and fans 35 for circulating internal air of the cooking chamber 30 so as to uniform the temperature in the cooking chamber 30 and rapidly cook the food materials may be installed on the rear surface of the cooking chamber 30. A fan cover 36 made of a platy member may be installed in the front of the fans 35. Circular through holes 37 are formed through the fan cover 36.

An electric component chamber 40, in which electric components including a circuit board (not shown) are installed, is provided above the cooking chamber 30. A control panel 41 including buttons and a display unit is installed on the upper portion of the front surface of the external case 10, such that a user can select the kinds of food to be cooked and control a cooking time, a cooking process, etc.

The circuit board (not shown) installed in the electric component chamber 40 is sensitive to heat, and thus hot air in the electric component chamber 40 must be circulated with external air. A discharge duct 42 and a cooling fan 43 are installed in the electric component chamber 40 such that air from the outside of the oven is inhaled and discharged in the forward direction of the oven. The discharge duct 42 discharges the air through an opening 44 provided between the external case 10 and the internal case 11.

Since the discharge duct 42 is connected to the cooking chamber 30, the air passing through the discharge duct 42 is mixed with the hot air in the cooking chamber 30 and is then discharged from the electric component chamber 40. That is, a connection hole 45 for connecting the cooking chamber 30 and the discharge duct 42 is formed through the upper surface of the internal case 11. A filter 46, which serves to remove gas, harmful to the human body, generated from the cooking chamber 30 during a cooking process, is inserted into the connection hole 45. Here, a plate 47 is installed above the connection hole 45, and prevents the hot air, passed through the connection hole 45, from flowing backward to the inside of the cooking chamber 30. The plate 47 is screw-connected to the upper surface of the internal case 11 and is opened toward the opening 44. If there is no plate 47, air blown by the cooling fan 43 may move to the cooking chamber 30 through the connection hole 45.

The discharge duct 42 is screw-connected to the upper surface of the internal case 11. When the discharge duct 42 is connected to the internal case 11, the channel of the discharge duct 42 has a venturi tube shape such that the channel is narrowed from the rear portion thereof to the front portion thereof. Further, a protrusion 48 having a designated height is formed on the upper surface of the internal case 11, and further narrows the front portion of the channel of the discharge duct 42. Thereby, the velocity of air passing through the opening 44 provided at the front end of the discharge duct 42 is relatively increased, and thus the pressure is relatively lowered. That is, the pressure at the upper portion of the door 20 is lower than the pressure at the lower portion of the door 20. Hereinafter, the structure of the door 20, which concurrently maintains cooling and heat-insulating capacities using the difference of pressures between the upper and lower portions of the door 20 will be described.

The door 20 includes a plurality of door glasses 22, made of a transparent material such that a user can see the inside of the cooking chamber 30, at the central region, and a door frame 23, on which the door glasses 22 are installed. A regular gap is formed between the door glasses 22, and upper and lower ends of the gap are opened. Thus, air flows from the lower portion of the door 20 to the upper portion of the door 20 along the gaps formed between the door glasses 22 due to the difference of pressures between the upper and lower portions of the door 20.

Figure 3:
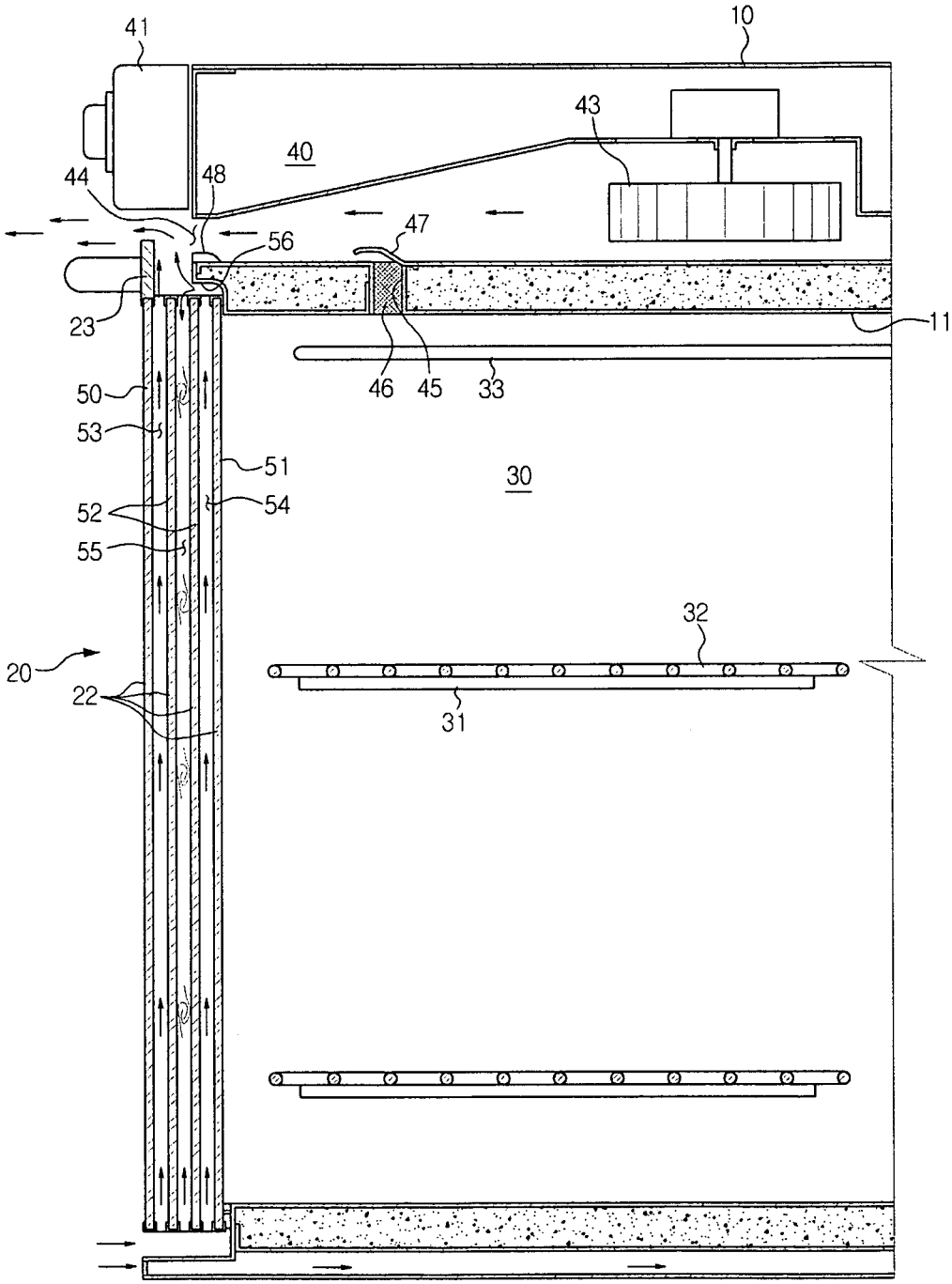
FIG. 3 is a cross-sectional view of a door having four door glasses of an oven in accordance with an embodiment of the present invention.

FIG. 3 is a cross-sectional view of a door having four door glasses of an oven in accordance with an embodiment of the present invention. Reference numbers provided in FIG. 3 but not described in detail below, are similar to the same numbered elements in FIG. 2, and thus any redundant description has been omitted.

As shown in FIG. 3, a door 20 may include a front glass 50 installed on the front surface of a door frame 23, a rear glass 51 installed on the rear surface of the door frame 23, and two middle glasses 52 installed between the front glass 50 and the rear glass 51. Here, a channel formed between the front glass 50 and the middle glass 52 being adjacent thereto may be referred to as a front channel 53, a channel formed between the rear glass 51 and the middle glass 52 being adjacent thereto may be referred to as a rear channel 54, and a channel formed between the neighboring two middle glasses 52 may be referred to as a middle channel 55.

In the case that the door 20 is closed so as to close the cooking chamber 30, the rear surface of the door 20 may partially contact the internal case 11. Here, a flow conversion part 56 protruding forwardly may be formed at the upper end of the front surface of the internal case 11. The flow conversion part 56, which is bent toward the door 20, may be formed integrally with the internal case 11, or may be formed separately from the internal case 11 and connected to the internal case 11. The flow conversion part 56 may be disposed above the rear channel 54. Preferably, the front end of the flow conversion part 56 may be disposed above the middle glass 52 adjacent to the rear glass 51.

In the front, rear, and middle channels 53, 54, and 55, formed by the plurality of the door glasses 22, air flows from the lower portion of the door 20 to the upper portion of the door due to the difference of pressures between the upper and lower portions of the door 20. Thus, external air, which flows between the plurality of the door glasses 22, absorbs heat of a high temperature transmitted from the cooking chamber 30 and then discharges the heat to the outside. More specifically, while air flows upwardly in the front and rear channels 53 and 54, the air absorbs heat of a high temperature transmitted from the cooking chamber 30 and then discharges the heat to the outside. That is, the front channel 53 and the rear channel 54 serve to cool the door 20.

On the other hand, the middle channel 55 serves to insulate the door 20 from heat so as to prevent heat in the cooking chamber 30 from being discharged to the outside. Air flows upwardly in the lower portion of the middle channel 55 due to the difference of pressures between the upper and lower portions of the door 20. However, the flow conversion part 56 is provided above the rear channel 54, and a portion of the air, passed through the rear channel 54, is reflected by the flow conversion part 56 and then enters the middle channel 55. More specifically, air flows upwardly in the lower portion of the middle channel 55, and air flows downwardly in the upper portion of the middle channel 55. After a designated time has passed, the air flow in the middle channel 55 is stagnated, and thus prevents the heat transmitted from the cooking chamber 30 from being discharged to the outside.

Accordingly, the four door glasses 22 form the front, rear, and middle channels 53, 54, and 55, and the flow conversion part 56 is provided above the rear channel 54, thereby forming the door 20, which can be concurrently cooled and insulated from heat.

Figure 4:
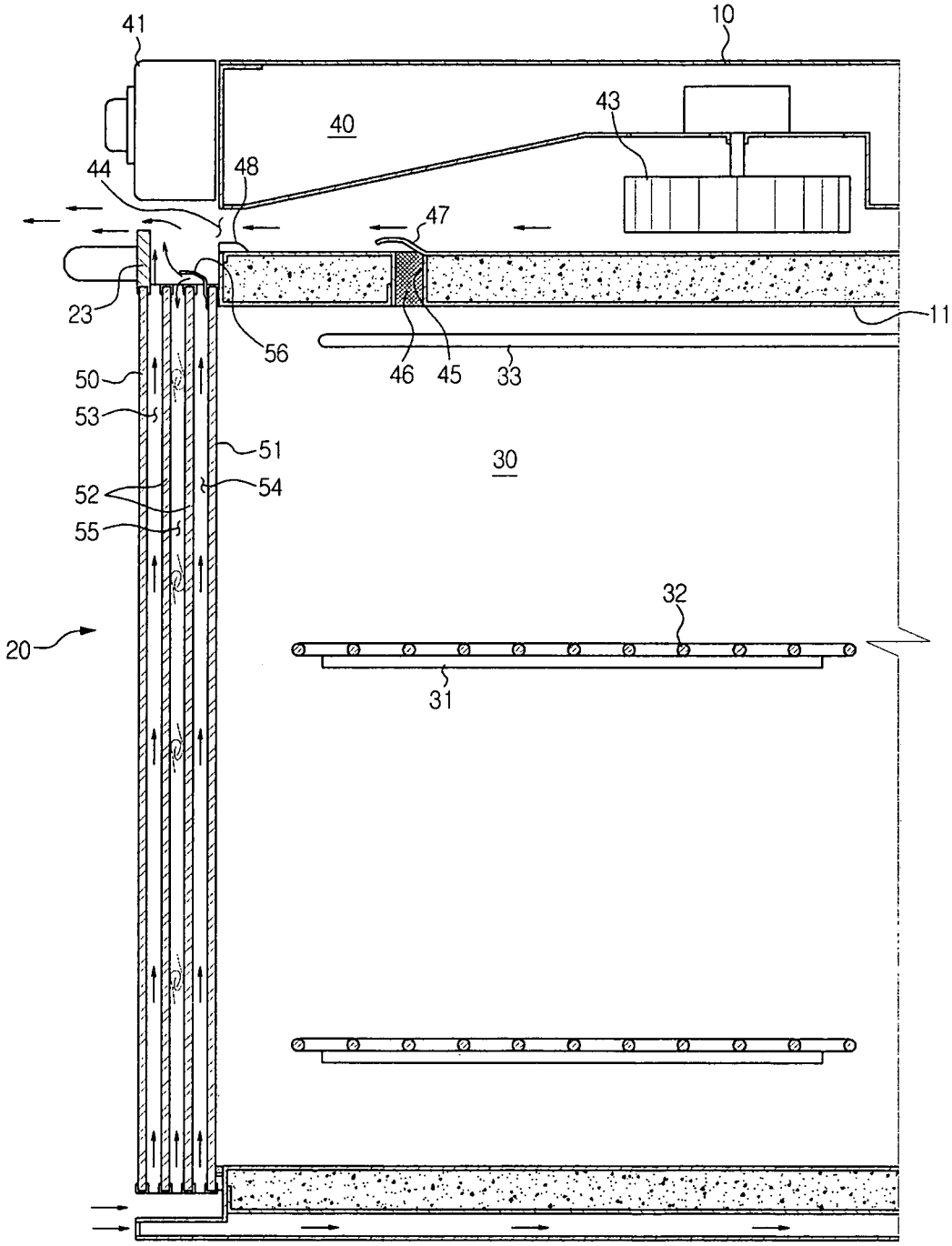
FIG. 4 is a cross-sectional view of a door having four door glasses of an oven in accordance with an embodiment of the present invention.

FIG. 4 is a cross-sectional view of a door having four door glasses of an oven in accordance with an embodiment of the present invention. Reference numbers provided in FIG. 4 but not described in detail below, are similar to the same numbered elements in FIG. 2, and thus any redundant description has been omitted.

As shown in FIG. 4, a door 20 may include four glasses, such as a front glass 50, a rear glass 51, and two middle glasses 52 installed between the front glass 50 and the rear glass 51. However, a flow conversion part 56 formed above the rear channel 54 may be connected to the rear glass 51, and may be bent toward the middle glasses 52. Thus, a portion of the air, passed through the rear channel 54, may enter the upper end of the middle channel 55.

Accordingly, as described above with reference to FIG. 3, the air flow in the middle channel 55 is stagnated, and thus prevents heat in the cooking chamber 30 from being discharged to the outside. Further, air flows upwardly in the front channel 53 and the rear channel 54, and thus discharges the heat, transmitted from the cooking chamber 30, to the outside.

Figure 5:
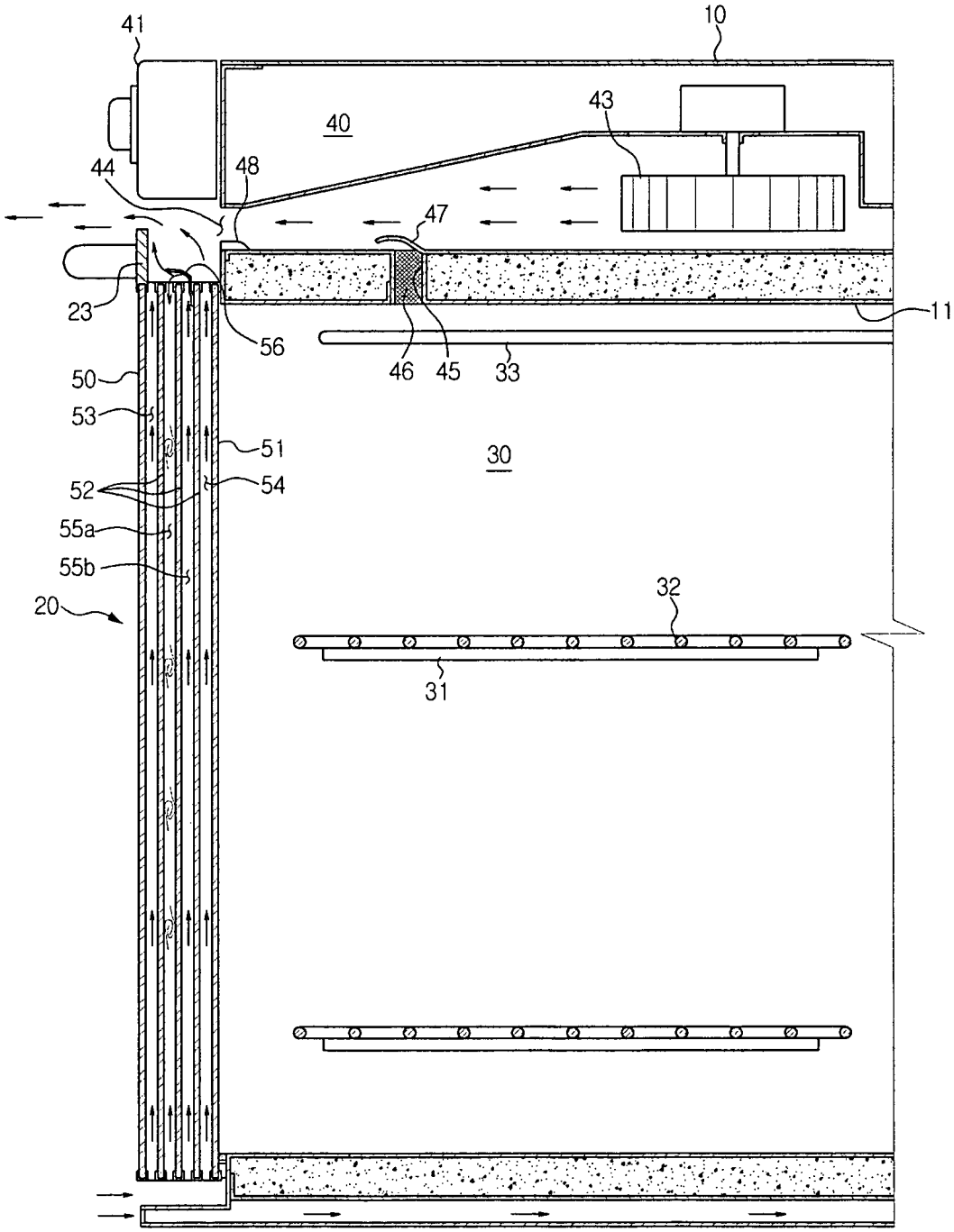
FIG. 5 is a cross-sectional view of a door having five door glasses of an oven in accordance with an embodiment of the present invention.

FIG. 5 is a cross-sectional view of a door having five door glasses of an oven in accordance with an embodiment of the present invention. Reference numbers provided in FIG. 5 but not described in detail below, are similar to the same numbered elements in FIG. 2, and thus any redundant description has been omitted.

As shown in FIG. 5, a door 20 may include five glasses, such as a front glass 50, a rear glass 51, and three middle glasses 52 installed between the front glass 50 and the rear glass 51. Thus, a front channel 53 may be formed between the front glass 50 and the middle glass 52 being adjacent thereto, a rear channel 54 may be formed between the rear glass 51 and the middle glass 52 being adjacent thereto, and two middle channels 55*a* and 55*b* may be respectively formed between the three neighboring middle glasses 52. The middle channel being adjacent to the front channel 53 may be referred to as a first middle channel 55*a*,and the middle channel being adjacent to the rear channel 54 may be referred to as a second middle channel 55*b*.

Air flows upwardly in the front and rear channels 53 and 54 due to the difference of pressures between the upper and lower portions of the door 20. However, the air flow in any one of the first middle channel 55*a* and the second middle channel 55*b* may be stagnated so as to allow the door 20 to have a heat insulating effect. For example, a flow conversion part 56 may be formed above the second middle channel 55*b* such that a portion of the air passing through the second middle channel 55*b* enters the first middle channel 55*a*. Accordingly, since air flows upwardly in the lower portion of the first middle channel 55*a* and air flows downwardly in the upper portion of the first middle channel 55*a*, after a designated time has passed, the air flow in the first middle channel 55*a* is stagnated.

However, as shown in FIG. 5, in order to allow the door 20 having the five door glasses 50, 51, and 52 to have a heat insulating effect, the air flow in the first middle channel 55*a* need not be stagnated. That is, it is possible to install the flow conversion part 56 above the rear channel 54 in order to stagnate the air flow in the second middle channel 55*b*. Of course, it is possible to concurrently install one flow conversion part 56 above the second middle channel 55*b* and another flow conversion part 56 above the rear channel 54 in order to stagnate the air flow in both the first and second middle channels 55*a* and 55*b*.

FIGS. 3 to 5 respectively illustrate structures, in which at least two middle glasses 52 may be installed between the front glass 50 and the rear glass 51 and the flow of air in the middle channel(s) 55 (55*a* and 55*b* in FIG. 5), formed between the at least two middle glasses 52 is stagnated so that the front channel 53 and the rear channel 54 serve to cool the door 20 and the middle channel(s) 55 (55*a* and 55*b* in FIG. 5) serve(s) to insulate the door 20 from heat.

Hereinafter, structures of the door 20, in which the front channel 53 serves to insulate the door 20 from heat and the rear channel 54 serves to cool the door 20, will be described.

Figure 6:
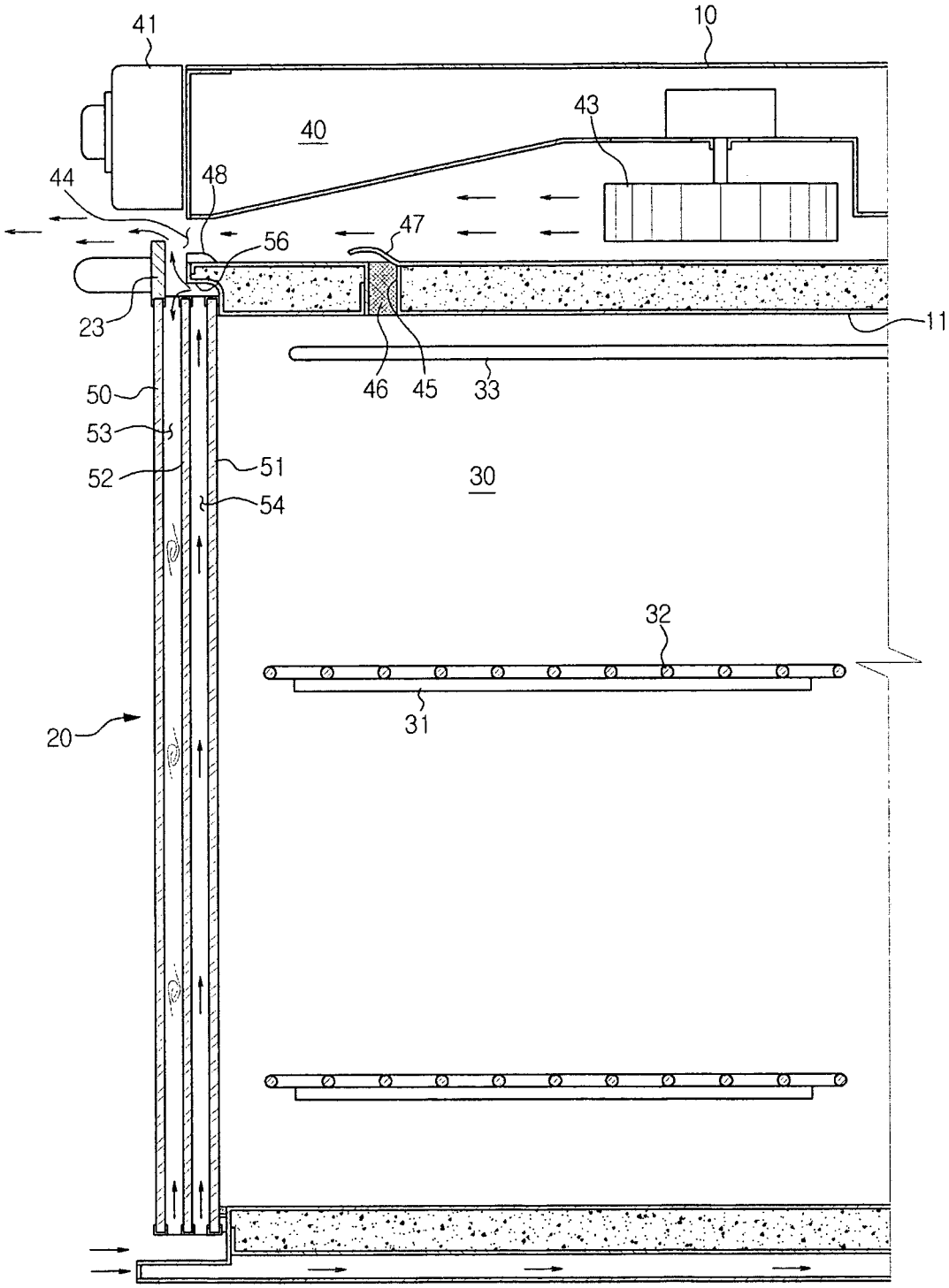
FIG. 6 is a cross-sectional view of a door having three door glasses of an oven in accordance with an embodiment of the present invention.

FIG. 6 is a cross-sectional view of a door having three door glasses of an oven in accordance with an embodiment of the present invention. Reference numbers provided in FIG. 6 but not described in detail below, are similar to the same numbered elements in FIG. 2, and thus any redundant description has been omitted.

As shown in FIG. 6, a door 20 may include a front glass 50 installed on the front surface of a door frame 23, a rear glass 51 installed on the rear surface of the door frame 23, and one middle glass 52 installed between the front glass 50 and the rear glass 51. Here, a channel formed between the front glass 50 and the middle glass 52 may be referred to as a front channel 53, and a channel formed between the rear glass 51 and the middle glass 52 may be referred to as a rear channel 54.

In the case that the door 20 is closed so as to close the cooking chamber 30, the rear surface of the door 20 may partially contact the internal case 11. Here, a flow conversion part 56 protruding forwardly may be formed at the upper end of the front surface of the internal case 11.

The rear channel 54, in which air flows upwardly due to the difference of pressures between the upper and lower portions of the door 20, absorbs heat transmitted from the cooking chamber 30, and then discharges the heat to the outside. Simultaneously, a portion of the air, passed through the rear channel 54, may be reflected by the flow conversion part 56 and then enters the front channel 53. Accordingly, since air flows upwardly in the lower portion of the front channel 53 and air flows downwardly in the upper portion of the front channel 53, after a designated time has passed, the air flow in the front channel 53 is stagnated. Thereby, the front channel 53 prevents the heat, transmitted from the cooking chamber 30, from being discharged to the outside.

Figure 7:
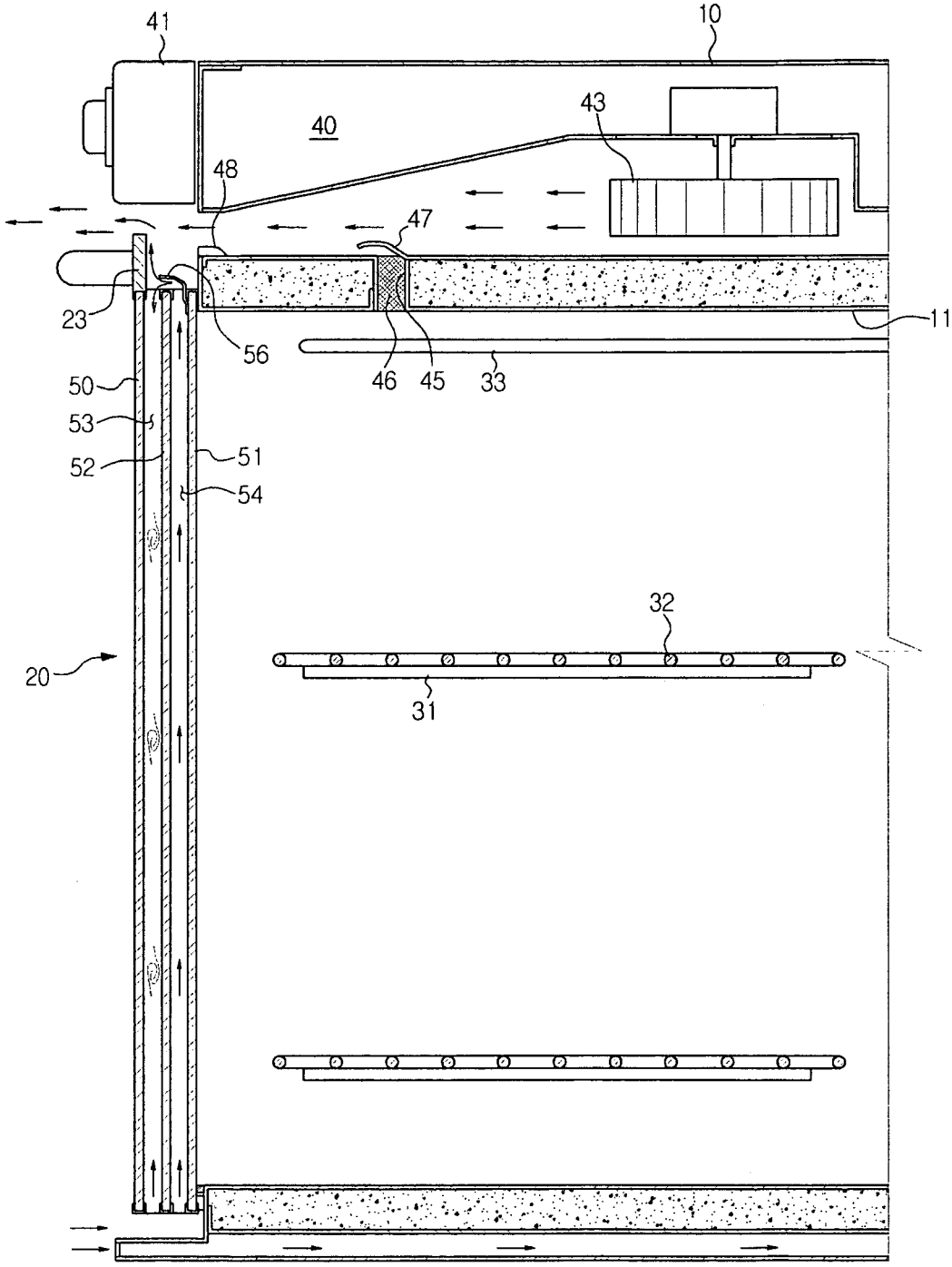
FIG. 7 is a cross-sectional view of a door having three door glasses of an oven in accordance with an embodiment of the present invention.

FIG. 7 is a cross-sectional view of a door having three door glasses of an oven in accordance with an embodiment of the present invention. Reference numbers provided in FIG. 7 but not described in detail below, are similar to the same numbered elements in FIG. 2, and thus any redundant description has been omitted.

As shown in FIG. 7, a flow conversion part 56 may be formed above a rear channel 54, connected to a rear glass 51, and bent toward a middle glass 52. Accordingly, since a portion of the air, passed through a rear channel 54, may enter a front channel 53, the air flow in the front channel 53 may be stagnated such that the door 20 has a heat insulating effect, and air flows in the rear channel 54 such that the door 20 has a cooling effect.

Figure 8:
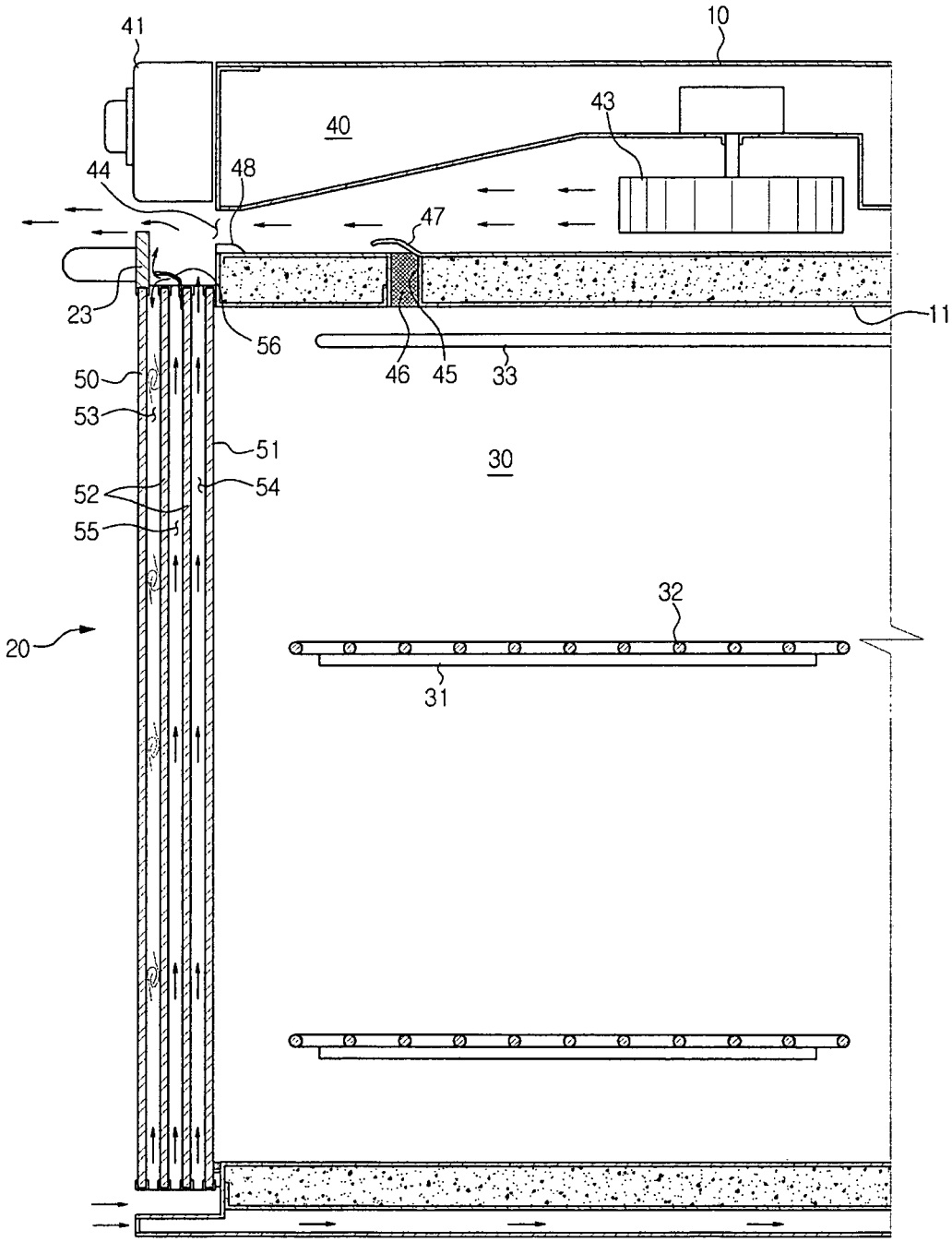
FIG. 8 is a cross-sectional view of a door having four door glasses of an oven in accordance with yet an embodiment of the present invention.

FIG. 8 is a cross-sectional view of a door having four door glasses of an oven in accordance with an embodiment of the present invention. Reference numbers provided in FIG. 8 but not described in detail below, are similar to the same numbered elements in FIG. 2, and thus any redundant description has been omitted.

Similar to the embodiments of FIGS. 3 to 5, two middle glasses 52 may be installed between a front glass 50 and a rear glass 51. However, in FIG. 8, a flow conversion part 56 may be installed above a middle channel 55 adjacent to a front channel 53 in order to stagnate the air flow in the front channel 53. More specifically, the flow conversion part 56 may be installed on the middle glass 52 adjacent to the rear glass 51, and thus a portion of the air passing through the middle channel 55 enters the front channel 53.

Thereby, since the front channel 53 serves to insulate the door 20 from heat, and the middle channel 55 and rear channel 54 serve to cool the door 20, it is possible to form the door 20, which concurrently satisfies heat insulating and cooling of the door 20 by adjusting the air flow.

As apparent from the above description, embodiments of the present invention provide an oven having a door, which is easily cooled by an air flow between a plurality of door glasses due to a difference of pressures between upper and lower portions of the door using a venturi effect.

Further, since a discharge duct of an electric component chamber for discharging hot air is formed into a venturi tube shape such that the door can be cooled by the difference of pressures between upper and lower portions of the door, the oven does not require a separate cooling device, thus lowering a production cost.

Further, the door of the oven includes at least one channel, in which an air flow is stagnated by a flow conversion part, between the door glasses, and thus insulates a cooking chamber from heat.

Accordingly, since the door is cooled using the difference of pressures between upper and lower portions of the door, and insulates the cooking chamber from heat, the oven described in embodiments of the present invention concurrently satisfies two conflicting requirements; heat insulating and cooling of the door.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An oven comprising:

a door including a frame;

a front glass and a rear glass, respectively installed on front and rear surfaces of the door frame;

at least two middle glasses installed between the front glass and the rear glass;

a front channel formed between the front glass and a first glass of the at least two middle glasses being adjacent thereto such that air can flow in the front channel;

a rear channel formed between the rear glass and the second glass of the at least two middle glasses being adjacent thereto such that air can flow in the rear channel;

at least one middle channel formed between the at least two middle glasses;

an internal case defining a cooking chamber opened and closed by the door frame; and at least one flow redirecting part to aid in transferring heat generated in the cooking chamber to the outside of the oven, wherein the at least one flow redirecting part includes a first flow redirecting part extended from a front surface of the internal case and disposed above the rear channel to indirectly aid in transferring the heat by discharging air flowing through the rear channel, which faces the cooking chamber forwardly toward the door, to the outside of the oven, and a second flow redirecting part disposed above a connection hole formed through an upper surface of the internal case to directly aid in transferring the heat by discharging hot air in the cooking chamber to the outside of the oven, the first flow redirecting part changes a direction of a portion of air passing through the rear channel, and the first flow redirecting has a length capable of changing the direction of the portion of the air passing through the rear channel to the least one middle channel while being spaced apart and separated from the door frame when the door is in a fully closed position to close the cooking chamber.

2. The oven according to claim 1, wherein:

the at least two middle glasses are installed between the front glass and the rear glass; and the at least one middle channel, in which the flow of air is stagnated, is formed between the at least two middle glasses.

3. The oven according to claim 1, further comprising:

a cooling fan for inhaling external air and blowing air; and a discharge duct for discharging the air, blown by the cooling fan, to a top of the door frame, wherein air flows upwardly in the front channel and the rear channel.

4. The oven according to claim 1, wherein the first flow redirecting part is formed integrally with the internal case.

5. The oven according to claim 1, wherein when the door is in the fully closed position to close the cooking chamber, the first flow redirecting part is spaced apart and separated from the door frame such that the first flow redirecting part does not change a direction of air passing through the front channel.

6. The oven according to claim 1, wherein when the door is in the fully closed position, a gap is formed in a front to rear direction of the oven between a front end part of the first flow redirecting part and the front surface of the door frame, and when the door is in the fully closed position, air passing through at least one of the front channel and the rear channel flows upwardly through the gap to the outside of the oven.

7. The oven according to claim 1, further comprising:

a cooling fan configured to blow air toward the door;

a discharge duct connected to the cooking chamber and in which the cooling fan and the second flow redirecting part are disposed; and an opening provided between the front surface of the door frame and a front end of the discharge duct, wherein the hot air in the cooking chamber passes through the connection hole directly into the discharge duct and the second flow redirecting part directs the hot air toward the door to be discharged through the opening to the outside of the oven.

8. The oven according to claim 7, wherein when the door is in the fully closed position, a gap is provided in a front to rear direction of the oven between a front end part of the first flow redirecting part and the front surface of the door frame, when the door is in the fully closed position, air passing through at least one of the front channel and the rear channel flows upwardly through the gap and is discharged to the outside of the oven via the opening, and when the door is in the fully closed position, the gap and opening are continuous such that air passing through the at least one of the front channel and the rear channel intersects with the hot air discharged through the opening to the outside of the oven.

* * * * *